US005623794A

United States Patent [19]

Bohls

[11] Patent Number: 5,623,794

[45] Date of Patent: Apr. 29, 1997

[54] FRAMING STRUCTURE APPARATUS AND METHOD FOR EARTH SHELTERED, MULTI-LEVEL STRUCTURE

[76] Inventor: Glen Bohls, 1208 Wedgewood Dr., Council Bluffs, Iowa 51501

[21] Appl. No.: 516,995

[22] Filed: Aug. 18, 1995

[51] Int. Cl.[6] ..... E02D 27/00

[52] U.S. Cl. ..... 52/169.6; 52/643; 52/690; 52/691

[58] Field of Search ..... 52/169.6, 169.1, 52/643, 690, 691; 405/16, 19

[56] References Cited

U.S. PATENT DOCUMENTS

| | | | |
|---|---|---|---|
| 1,840,397 | 1/1932 | Kayes . | |
| 2,081,380 | 5/1937 | Nachreiner | 72/5 |
| 2,166,577 | 7/1939 | Beckius | 72/77 |
| 2,846,731 | 8/1958 | Abler | 20/1 |
| 3,156,018 | 11/1964 | Slayter | 52/643 |
| 3,157,251 | 11/1964 | Rasch | 52/643 |
| 3,172,507 | 3/1965 | Blyveis | 52/643 |
| 3,668,828 | 6/1972 | Nicholas et al. | 52/690 X |
| 4,030,256 | 6/1977 | Ollman | 52/643 X |
| 4,073,103 | 2/1978 | McClure | 52/643 X |
| 4,074,487 | 2/1978 | Daniels et al. | 52/643 X |
| 4,334,393 | 6/1982 | U'Ren | 52/169.6 |
| 4,352,260 | 10/1982 | Pearcey et al. | 52/80 |
| 4,439,959 | 4/1984 | Helfman | 52/169.1 X |
| 4,488,392 | 12/1984 | Pearcey et al. | 52/169.6 X |
| 4,590,721 | 5/1986 | Berg et al. | 52/169.1 |
| 4,656,792 | 4/1987 | Clark | 52/643 X |
| 4,894,964 | 1/1990 | Thrift et al. | 52/643 X |
| 5,022,202 | 6/1991 | Johnson, Jr. | 52/169.6 |
| 5,341,611 | 8/1994 | Lewis | 52/643 X |

*Primary Examiner*—Wynn E. Wood
*Assistant Examiner*—Beth Aubrey
*Attorney, Agent, or Firm*—John A. Beehner

[57] ABSTRACT

The present invention discloses a multi-level, earth sheltered structure having a foundation for supporting the structure and corresponding to the exterior shape of the structure. The teachings and techniques of the present invention are applicable to both commercial and residential structures. Two truss design embodiments are disclosed both producing a slanted outer wall which reduces some of the forces acting on the structure. Use of both earth covered and exposed roofs are accommodated. A thermal envelope may be utilized further maximizing thermal efficiency. Interior walls may be constructed in the conventional manner, the layout being dictated by personal preference or commercial requirements.

17 Claims, 9 Drawing Sheets

FRAMING STRUCTURE APPARATUS AND METHOD FOR EARTH SHELTERED, MULTI-LEVEL STRUCTURE

BACKGROUND OF THE INVENTION

1. Technical Field

The method and apparatus of the present invention relate generally to earth sheltered, multi-level structures. More specifically, the present invention relates to a method and apparatus for constructing the exterior frame of a multi-level earth-sheltered structure. As is well known in the art, subterranean structures are subject to significant lateral pressure. The novel design of the structure's frame minimizes the effect of this lateral pressure exerted by the earth against the sides of the structure. The minimization of lateral forces simplifies the design and cost of the structure. This allows a multi-level structure, heretofore too expensive, to be created.

Currently, most earth-sheltered structures utilize substantially vertical exterior framing similar to above ground structures. As is well known in the art, the earth exerts substantial lateral pressure below the surface acting against the sides of a structure. When vertical walls are used, this exterior framing is perpendicular to the lateral pressure. Consequently, the force acting on the external structure is maximized. As a result, the structure must be designed so as to withstand this horizontal pressure. As is also understood in the art, these forces vary linearly with depth. Therefore, a correspondingly more substantial structure is required as the depth, i.e. number of subterranean floors is increased. Clearly, as the substantiality of the structure increases, so to does its cost.

Due primarily to cost considerations, the current practice for construction of earth-sheltered structures, is to utilize a single level below ground. If a multi-level structure is desired, this means that at least one level will be "above ground." Clearly, this minimizes the benefits of an earth-sheltered structure.

Implementation of the support structure of the present invention allows multiple subterranean levels to be constructed, maximizing the benefits associated with earth sheltered construction. Use of the techniques taught by the present invention are applicable to both residential dwellings as well as commercial structures.

2. Description of the Prior Art

As mentioned, the most common earth-sheltered structure design implements exterior framing having a generally vertical orientation. Many examples of this exist including the homes illustrated in *Homes in the Earth* and *Earth Sheltered Residential Design Manual.* One of the primary concerns in the design of the structure is the earth load on the external walls. As taught in the prior art, this results in a need for shear walls to help resist the lateral forces exerted by such earth loads.

Clearly, there would be many different ways to accommodate this excessive side load. For example, the side wall could be of a sufficient thickness in order to withstand such pressures. Alternatively, materials for construction could be chosen having sufficient strength to withstand these side loads. Still further, bracing or other auxiliary support structures could be used to lend additional support to otherwise conventional framing. Inherent in such construction alternatives is the additional cost which would be associated therewith. Such costs would be not only in additional materials, but also in the labor to install them.

An alternative is to "neutralize" to some degree these lateral forces. This is the novel technique utilized by the present invention which results in a great cost savings both in terms of materials and in construction labor allowing multiple subterranean levels to be constructed.

As will be explained in more detail below, the technique taught by the present invention divides the lateral force present into both horizontal and vertical components thereby decreasing the amount of horizontal pressure which must be accommodated by the wall.

Consequently, there is a great need for a framing structure which permits the cost effective construction of multi-level earth-sheltered structures.

Therefore, it is a primary objective of the present invention to provide a framing apparatus and method of construction for multi-level, earth-sheltered structure wherein sufficient structural support therefor may be obtained without the need for heavy duty internal reinforcing structure.

A further objective of the present invention is to provide a support frame wherein the external wall thereof is slanted at an angle to the subterranean lateral forces thereby dividing the horizontal component of the load factor into a horizontal and vertical component and thereby decreasing the amount of horizontal pressure which must be accommodated by the wall.

It is a further objective of the present invention to provide an "interior frame" support structure wherein all framing members are contained within the exterior wall.

It is a further objective of the present invention to provide an "exterior frame" structure wherein a portion of the supporting structure is located external to the exterior wall.

It is a further objective of the present invention to provide a framing structure wherein safety and convenience are enhanced by having a rear egress.

A further objective is to provide a framing structure wherein an earth covered roof may be supported.

A still further objective is to provide a framing structure wherein a conventional, above earth roof may be supported.

A still further objective of the present invention is to provide a framing structure, portions of which may be preformed and shipped to the construction site for assembly, thereby eliminating the need for on-site assembly of each component of the structure.

It is a further objective of the present invention to provide a framing structure which may be used for a single level structure as well as for multi-level structures.

It is a further objective of the present invention to provide a framing structure adapted to allow air flow to circulate around the structure between the exterior and interior walls creating a "thermal envelope" promoting heating and cooling efficiencies.

It is a further objective of the present invention to provide a framing structure the trusses of which may be constructed from a variety of materials such as wood, steel, aluminum, and the like.

It is a further objective to provide a framing structure wherein the interior may be designed as desired.

It is a final objective to provide a framing structure as described above which may be used for both commercial and residential structures.

SUMMARY OF THE INVENTION

The present invention discloses a multi-level, earth sheltered building having a foundation for supporting the building and corresponding to the exterior shape of the structure. The teachings and techniques of the present invention are applicable to both commercial and residential structures. An exterior framing structure adapted to support an exterior wall and for supporting the structure is secured to the foundation. A first embodiment disclosed is an interior frame.

A plurality of stacked truss sets is adapted to define the perimeter of the structure, each of the sets being formed by a plurality of individual trusses stacked one atop the other. The number of trusses stacked corresponds to the number of floors in the structures. Each of the trusses include, a first generally vertical elongated inner member having top and bottom portions, a second outer elongated member having top and bottom portions, the outer member bottom portion being joined with the inner member at the bottom portion thereof, a connecting member connecting the inner and outer member top portions in a spaced apart relation such that the second member slopes upwardly and outwardly from the bottom portion thereof thereby defining an angle between the inner and outer members. Therefore, each truss is generally triangularly shaped. The bottom of the second truss is attached to the top of the first truss such that the outer slanted members of the trusses in the pair are aligned to present a substantially continuous outwardly sloping surface. The plurality of stacked truss sets are secured to the foundation in horizontally spaced apart relation defining the perimeter of the structure. The exterior wall is fastened to the truss sets thereby forming the exterior wall thereof. The dirt is then replaced adjacent to and in contact with the exterior wall. The upwardly and outwardly sloping exterior wall reduces some of the horizontal load associated with the underground structure.

The present invention so discloses an exterior frame wherein the truss design comprises a first generally vertical elongated inner member having top and bottom portions. A second outer elongated member having top and bottom portions is joined with the inner member at the bottom portion thereof. A connecting member connecting the inner and outer member top portions in a spaced apart relation such that the second member slopes upwardly and outwardly from the bottom portion thereof whereby each truss is generally triangularly shaped. In this exterior frame embodiment, the truss height corresponds to the height of the structure. The exterior frame embodiment provides additional structural support which may be especially beneficial in structurally challenging situation such as where an earth sheltered roof is employed.

Intermediate floors in the structure are accommodated in either design. In the interior frame embodiment, floor joists may be supported on the top connecting member of the truss. In the exterior frame embodiment, the floor joists may be supported by support members secured to the truss at intermediate positions corresponding to the floor level. The walls and flooring may be constructed so as to provide an air circulation zone defining a thermal envelop thereby further enhancing thermal efficiency of the structure.

Interior walls may be constructed in the conventional manner, the layout being dictated by personal preference or commercial requirements.

BRIEF DESCRIPTION OF THE DRAWINGS

FIG. 1 an outwardly directed perspective view of a portion of a back wall of the frame structure illustrating two floors thereof and showing the connection of the frame trusses and how the floor joists would be seated thereon, FIG. 2 is a top view of the truss construction of a corner of a single floor of the frame structure.

FIG. 3 is top view showing the construction of a corner in a two-floor embodiment and also illustrating the support of a roof, FIG. 4 is a side sectional view of a rear wall of the frame structure in a two-floor embodiment showing the support trusses and a floor joist seated thereon.

FIG. 5 a perspective view of trusses used to construct a corner in the frame structure of the present invention.

FIG. 6 is an end view of the frame structure of the present invention illustrating a rear egress which may be included therewith.

FIG. 7 is a top view of the rear egress structure of the framing apparatus of the present invention.

FIG. 8 is a side view of an entire earth-sheltered structure using the frame structure of the present invention.

FIG. 9 is a perspective view of the trusses used in a second embodiment of the frame structure of the present invention.

FIG. 10 is a top view showing the construction of a corner in an alternative embodiment.

FIG. 11 is a top view showing the support structure of the second alternate embodiment including the roof support structure.

FIG. 12 is a side view of the structure utilizing the second alternative embodiment including the support of a roof thereby.

FIG. 13 is a side view showing a truss of the second embodiment including the manner in which the two floors and an earth-sheltered roof would be supported.

DESCRIPTION OF THE PREFERRED EMBODIMENT

Figure 1:
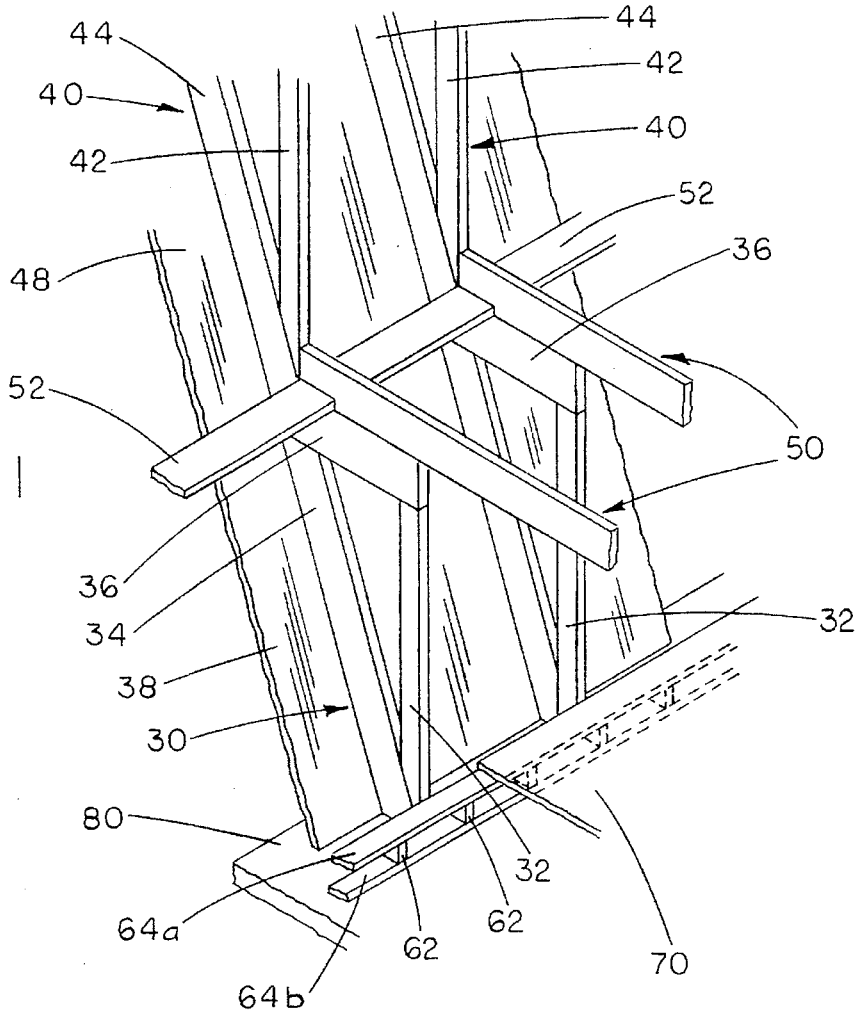
FIGS. 1–8 illustrate the primary embodiment for the present invention.

FIGS. 1–8 illustrate a first preferred embodiment of the present invention.

The theory behind the operational effectiveness of the present invention is twofold. First, by using a triangularly shaped truss to support the exterior wall, additional structural support is obtained resulting from this triangular shape. Secondly, by slanting the exterior wall which contacts the earth surrounding the structure, the lateral subterranean force is divided from a largely horizontal force into smaller vertical and horizontal components, thereby reducing the force against which the structure must compensate. It should be noted that the framing structure disclosed by the present invention relates primarily to the perimeter of the frame. Thus, details concerning the interior floor plans are not shown or discussed, that being left to the individual tastes and preferences of the resident. It should be further noted that the angular separation between the inner and outer members of the trusses, has been exaggerated in the figures to illustrate the shape thereof. For example, while the angle illustrated in the figures may appear to be approximately 45 degrees, it is believed that 10–15 degrees is more likely what would be used in practice, determined in part by soil type. However, the present invention encompasses all such angles and is not limited to any particular value or range and could range from nearly zero to 89 degrees.

In this first preferred embodiment, the vertical dimensions of the trusses used to make up the frame are one floor in height. Therefore, multi-level structures are constructed by vertically stacking trusses one upon the other, the number of trusses stacked being equivalent to the number of floors or levels in the structure. For example, in FIG. 1, two floors are illustrated wherein an upper second series of trusses 40 representing the second and any upper floors, are placed atop a lower first series of trusses 30 corresponding to the first floor. As seen in this outwardly looking figure, and using the first level series of trusses for numerical reference, each truss 30 comprises a generally vertical inner member 32 and an outwardly sloping outer member 34. As seen in the figure, members 32 and 34 are joined in the lower portions thereof and are horizontally spaced at the upper portion thereof such that a generally V-shaped structure is defined by the two members. The members may be individual components or integrally formed. The trusses may be constructed of wood, steel, aluminum, or other suitable material.

Horizontal top, connecting cross piece 36 is fastened to the upper portions of members 32 and 34 thereby forming a triangle. Cross member 36, in addition to providing structural rigidity to the truss, is used to support the floor joists 50 discussed below. As mentioned, in the preferred embodiment, truss 30 is mounted such that inner member 32 assumes a generally vertical orientation. When so mounted, outer truss member 34 is then oriented upwardly and outwardly relative to truss member 32. Interior vertical member 32 provides a support against which the interior sheetrock may be fastened. The outer sloping member 34, as explained further below, provides a support against which the exterior wall 38 may be secured.

As illustrated in the figure, a plurality of floor joist members 50 would be utilized to support the second floor. As is true with conventional construction, the plurality of floor joists 50 would be oriented to run from front to back of the structure. The floor joists 50 would be adapted to be secured to and rest on the top cross piece 36 of the trusses 30 positioned along the front or back of the structure. Additionally, a supporting plate 52 would be adapted to run between consecutive truss pairs as illustrated in the figure. This support plate 52 is adapted to be mounted to the top of cross piece 36 adjacent the vertical member 42 of the second floor truss 40. Floor joists 50 would have a generally rectangular notch 54 cut into the outer portion thereof for receiving plate 52 as indicated. Thus, support plate 52 provides an additional connection for securing the floor joists 50 to the trusses 30. Additionally, support plate 52 provides additional lateral support for consecutive truss pairs.

As mentioned above, in this first embodiment, a multi-level structure embodying the teachings of the present invention would have a number of stacked trusses equivalent to the number of floors or levels. The trusses associated with each level would have an identical construction. Thus, a second floor truss 40 would have a generally vertical inner member 42, an outwardly sloping outer member 44 joined at the lower portion thereof, and a top cross piece 46 mounted to the upper portions of members 42 and 44. Therefore, members 42, 44, and 46 of upper truss 40 correspond to members 32, 34, and 36 of lower truss 30.

As seen in FIG. 1 and illustrated in the figures below, the upper, second floor trusses 40 are mounted to the lower, first floor trusses in such a fashion that the outer, upwardly sloping member 44 of upper truss 40 in conjunction with member 34 of lower truss 30 forms a nearly continuous, upwardly and outwardly sloping surface.

As mentioned above, the outwardly and upwardly sloping members 34, and 44 of the lower and upper truss pairs 30 and 40 provide a means for supporting an exterior wall. By securing the exterior wall to members 34 and 44, the wall will have an upwardly and outwardly sloping orientation corresponding to members 34 and 44 to which it is mounted. In a preferred embodiment of the invention, the trusses 30 and 40 would be spaced at approximately eighteen inch intervals. Additionally, the exterior wall could be comprised of conventional 4'×8' sheets of plywood. In such a case, the sheets could be mounted widthwise on center of alternating trusses. Clearly, other sizes of wall segments could be used. Sealing between segments would be accomplished in a conventional manner such as by caulking or the like. For the purposes of discussion herein, exterior wall segments secured to lower trusses 30 are designated 38 and exterior wall segments secured to upper trusses 40 are designated 48 although a single appropriately sized segment could be used. This exterior wall surface 38 and 48 would be secured to the outwardly and upwardly sloping member 34 and 44, respectively, by means of conventional nails or the like.

As mentioned above, this upwardly and outwardly sloping exterior wall surface 38 and 48 provides the means by which the invention's objectives are partially accomplished. As will be clear to those with at least an elementary understanding of physics, a horizontal force vector acts on a surface angle thereto the resulting force acting on the surface may be thought of as the sum of two smaller forces. Consequently, by slanting the exterior wall, the effect of the horizontal force is reduced and hence the structural support necessary to withstand this force is reduced. Combining this decrease in lateral force with the increase in structural support resulting from the triangular truss design results in the practicality of multi-level subterranean structures.

As mentioned above, the horizontal force acting on the wall increases with depth below ground. Since the slanting of the wall decreases the effect of this force, the structure may be built to a greater depth (i.e. more levels to a point where the horizontal force acting on the surface reaches the structural limit). In addition to the decrease in the horizontal force component resulting from the slant in the exterior wall, the triangular construction of the trusses provides greatly enhanced rigidity and structural integrity.

As mentioned above, since the truss 30 is mounted to concrete slab 80 in such a manner that member 32 assumes a generally vertical orientation and since member 34 and 32 are joined at the lower portions thereof but with the upper portions being horizontally spaced, it is clear that an angle is defined by members 32 and 34 with the apex thereof being at the juncture of members 34 and 32. As mentioned, the amount of this angle determines the quantity of advantage which may be achieved due to the slanted wall portion of the present invention support structure. It is envisioned that it might be desirable to utilize different degrees of slant between members 32 and 34 in order to minimize the negative effects of the lateral forces present in different soil types.

While it is within the scope of this invention that the framing trusses would be individually constructed at the building site and therefore specifically designed to accommodate the soil type existing at the construction site, for economic reasons, it may be desirable to have trusses prefabricated and shipped to the construction site. In that case, the trusses could be prefabricated with a pre-set angular separation which would accommodate most soil types. Thus, the prefabricated trusses could simply be shipped to the building site without the need for assembly. Alternatively, a series of prefabricated trusses could be constructed having several different angular mounts to accommodate a certain number of soil types.

Finally, FIG. 1 illustrates the means used to support the flooring for the first floor of the structure. As mentioned above, in one embodiment, the entire structure rests on a concrete slab 80 which is poured as the foundation for the structure. It is this concrete slab 80 on which the first floor trusses 30 are mounted. In another embodiment, a concrete foundation would be poured around the perimeter of the structure. In either case, the trusses 30 would be secured to the concrete by conventional securement means such as anchor bolts, similar to the way in which the frame of a conventional home is secured to the foundation.

The floor 70 of the lowest level would be supported by a floor support means 60 comprising a series of floor support studs 62 seated between a pair of upper and lower 2×4 floor mounting plates 64*a* and 64*b* respectively. Lower plate 64*b* in turn could be secured to concrete slab 80 as shown using conventional concrete nails, anchor bolts, or the like. Alternatively, plate 64*b* could be supported on a bed of grave, sand, or the like. In the preferred embodiment, these floor support studs 62 would be a plurality of rectangularly shaped wood blocks, for example, small lengths of 2×4's. Floor 70 would then be secured to the plate 64*a* by means of conventional nails or the like. In the preferred design floor support studs 62 would be of sufficient height to permit air to circulate freely under the floor in order to implement the thermal envelope discussed in more detail below. This technique, utilizing floor mounting plates 64*a* and 64*b*, is preferable in that it lends additional lateral stability to the floor support studs 62 as well as providing an easier surface into which the floor 70 may be nailed. It is contemplated that a plurality of plates running width wise under the floor would be used although other configurations would be equally suitable. The floor mounting plates 64*a* and 64*b* would be secured to the floor support studs by means of conventional nails or the like.

As mentioned above, the exterior walls having contact with the earth, normally the rear and side walls are constructed according to the slanted design disclosed herein. FIG. 1 illustrates the techniques used to construct the side and rear walls as taught by the present invention using a plurality of trusses 30 in order to create a wall structure having an upwardly and outwardly slanted orientation. However, the corners of the structure provide a special challenge since the angled surfaces of adjacent perpendicular walls must be accommodated.

A special corner piece is provided to accommodate the junction of the side and rear walls. In the preferred embodiment, it is envisioned that this corner construction could be provided by a prefabricated corner insert 90 which could be shipped to the construction site, preassembled and ready to be inserted into place. Alternatively, corner piece 90 could be constructed at the job site. This corner piece is illustrated in FIGS. 2 and 5 below.

Figure 2:
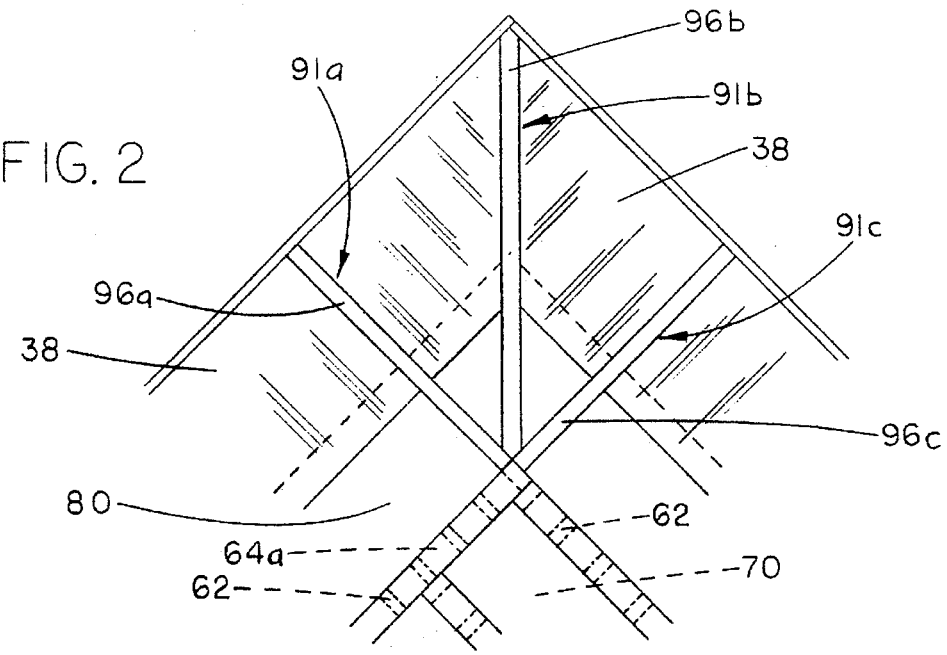
Figure 5:
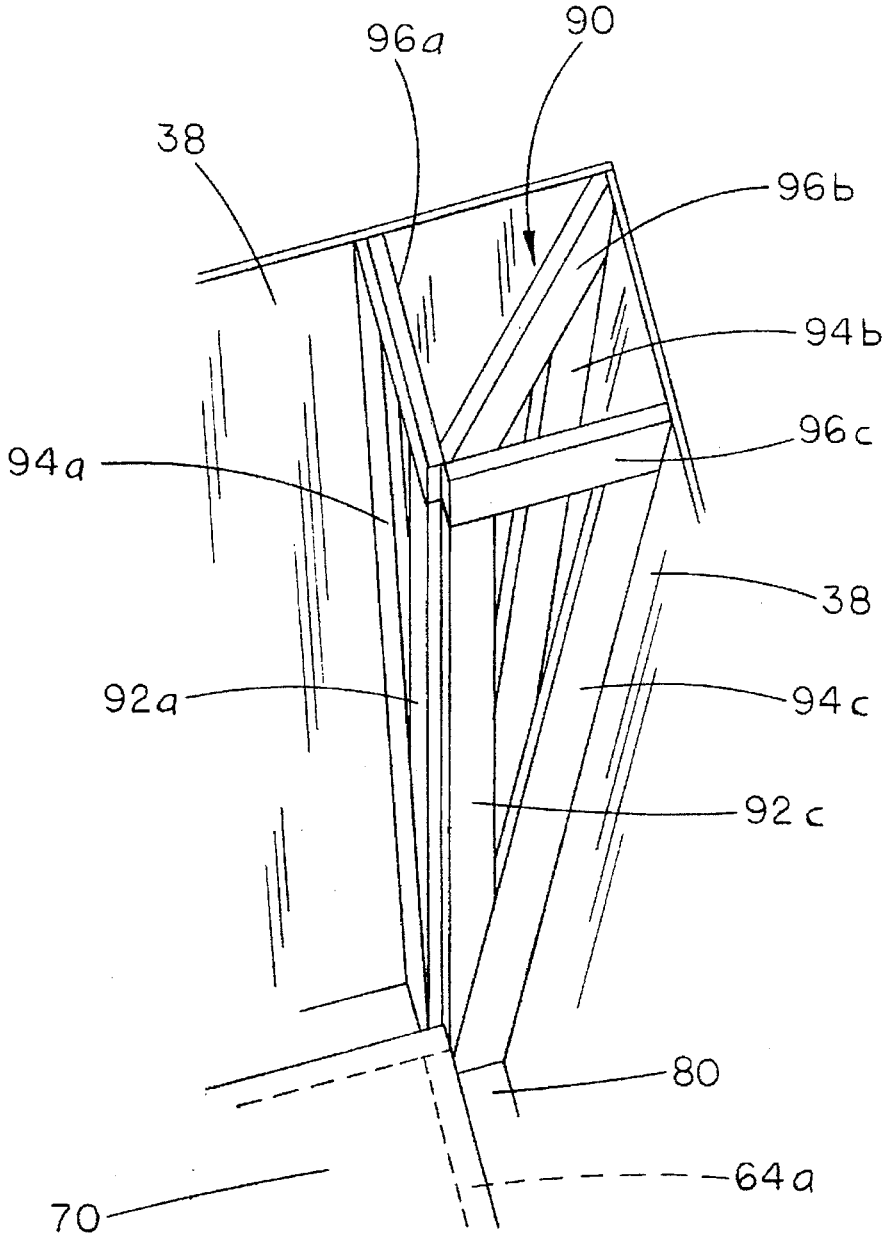

FIGS. 2 and 5 are top and perspective views, respectively, of a corner piece 90 which might be used with the present invention. As seen in this figure, the corner piece 90 would comprise three trusses 91*a–c*. Generally speaking, these trusses 91*a–c* assume a generally V-shape similar to wall trusses 30 and 40, having a generally vertical inside member 91*a–c*, an outwardly slanted outer member 94*a–c* the inner and outer members being joined at the bases thereof. A top cross piece 96*a–c* is adapted to connect the inner and outer members. The three trusses 91*a–c* making up the corner piece 90 differ from the other trusses in that the angle between the inner and outer members thereof must be such as to permit the junction of the outer walls 38 from perpendicular wall segments such as side and rear walls. While this is not difficult, it is a consideration which must be taken into account when designing the corner piece 90. The exterior walls 38 would be fastened to the outward slanted member 94*a–c* in the same manner as with the other trusses, namely by use of nails or other conventional fastening means.

Figure 3:
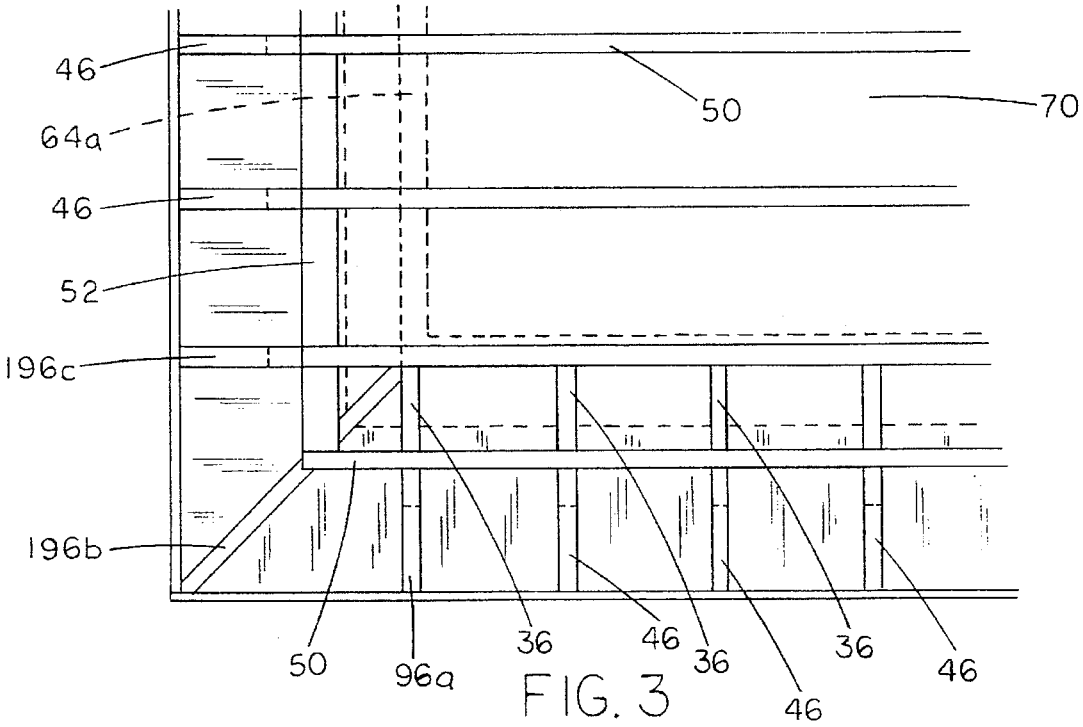
Figure 4:
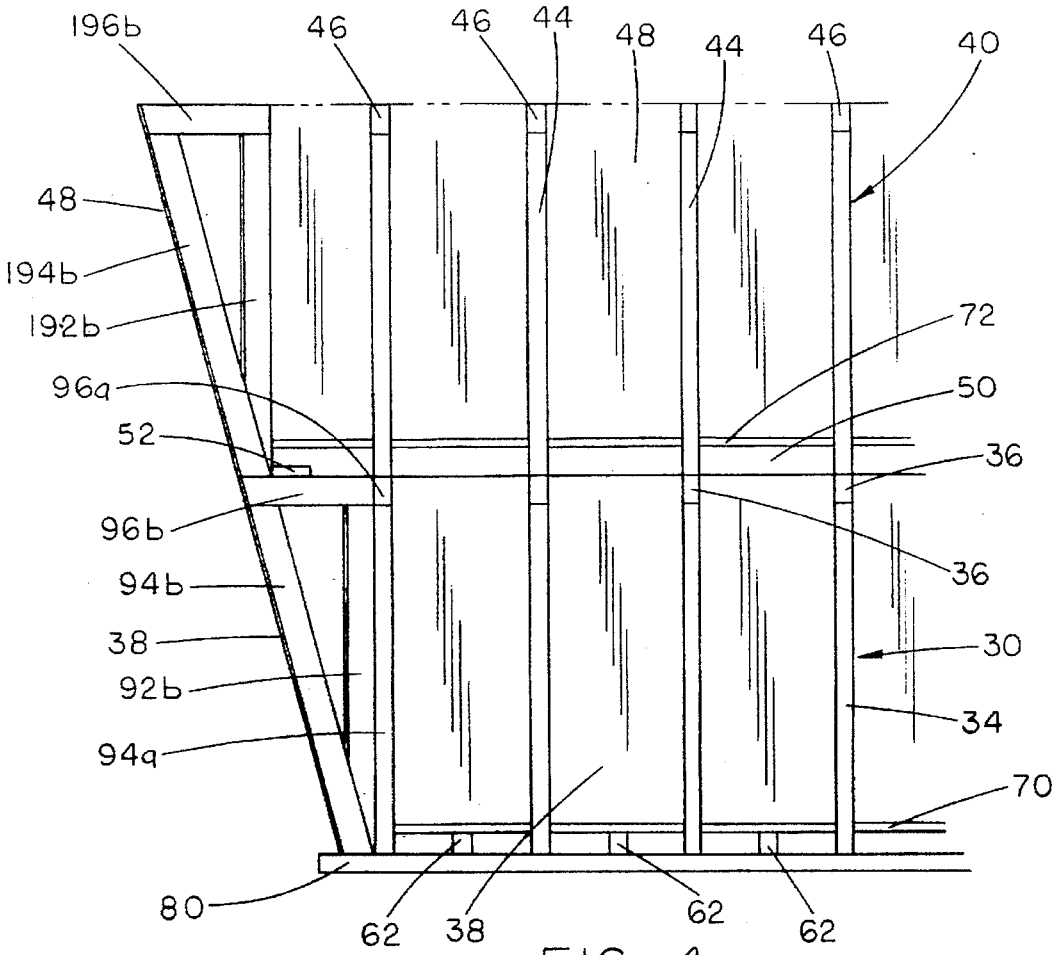

FIGS. 3 and 4 represent top and side views, respectively, of a two-story embodiment utilizing the concepts and teachings of the present invention. As mentioned above, and as can be seen clearly in the figures, especially FIG. 4, the upper trusses 40 are mounted on the top cross piece 36 of the bottom trusses 30 such that the outer, sloping members 34 and 44 form a generally continuous, outwardly sloping surface. Thus, when the outer exterior wall 38 and 48 are mounted to the outer truss members 34 and 44, they form a continuous, outwardly and upwardly sloping flat surface. As mentioned above, the fill dirt would be pushed up against these exterior wall surfaces 38 and 48.

Also shown in FIGS. 3 and 4 are top and side views, respectively, of a two-story embodiment of a corner construction according to the teachings of the present invention. An upper corner piece 190 is positioned atop the lower corner piece 90 in a manner similar to the way in which the upper trusses 40 are positioned atop lower trusses 30. Namely, the upper slanted member 194*b* is positioned atop member 94*b* so as to present as continuous a sloping surface as possible. As mentioned, it is along this surface that exterior walls from adjacent sides of the structure would be joined. In order to facilitate this joining of adjacent exterior sides, it will be noted from FIG. 3 that the outer slanted members 94*b* and 194*b* are beveled so as to present a flat mounting surface to the side being secured.

Figure 7:
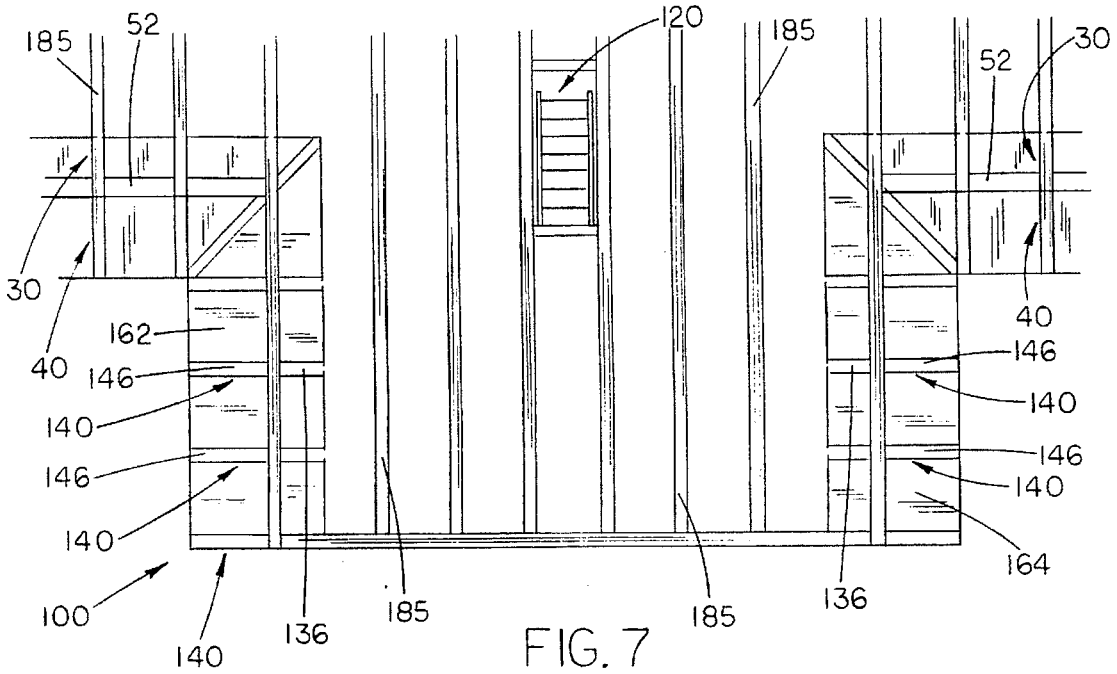

In addition to the structure discussed above, another unique feature of the present invention is its design of a rear egress 100 for the earth-sheltered structure. Providing a rear egress to the structure clearly enhances safety and convenience by providing a second means of escape in the case of fire or other emergency. Rear egress 100 is a feature heretofore not feasible on earth-sheltered structures. In the past, such a rear egress was difficult if not prohibitively expensive to build into an earth-sheltered structure. The present invention allows a rear egress to be easily accommodated in the present invention. Such a rear egress 100 is illustrated in FIGS. 6 and 7 below.

Figure 6:
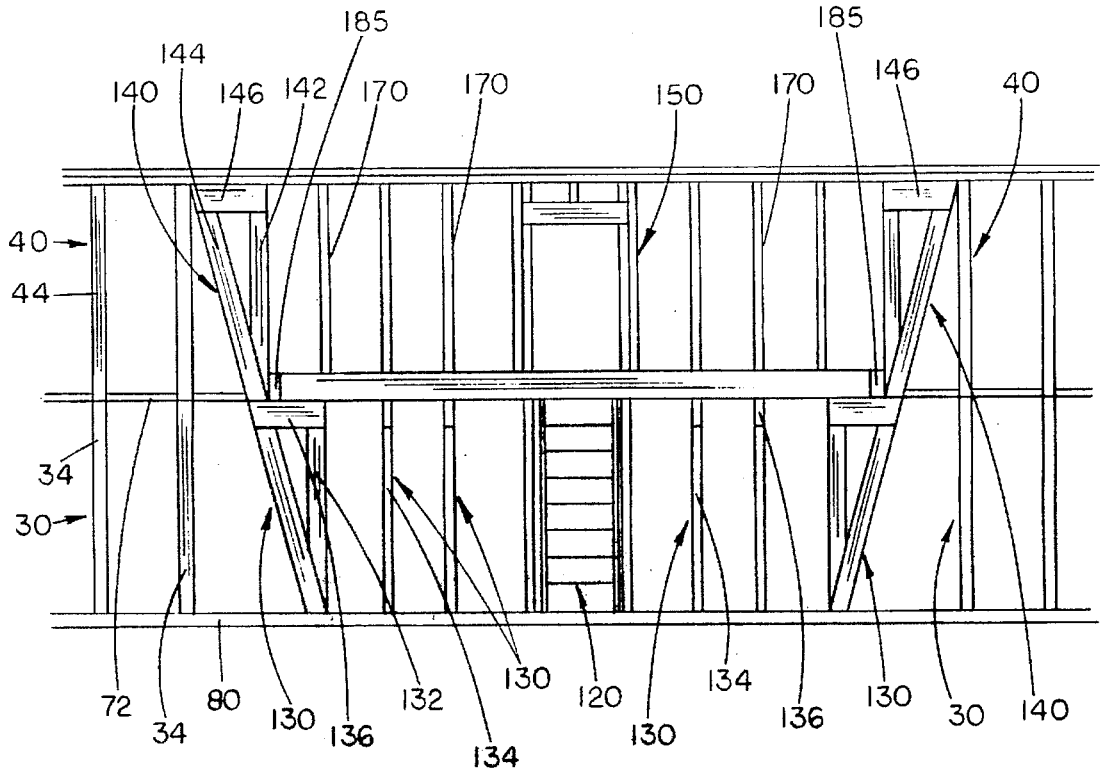

FIG. 6 is an end view of the present invention centered about the rear egress 100. As seen in the figure, the framing structure of the rear egress 100 is constructed in a fashion similar to that for the remaining structure. A plurality of trusses 130 and 140, similar to trusses 30 and 40 in the main structure, are stacked vertically as shown in order to create the multi-story rear egress of the structure. As indicated above in connection with the remainder of the structure, the number of stacked trusses would correspond with the number of floors in the multi-level structure. The vertical stacking of trusses 130 and 140 is accomplished in the manner described with the remaining structure, so that the outwardly and upwardly sloping member of the stacked trusses 134 and 144, form a generally continuous sloping surface. Again, as stated above, it is against the continuous, flat surface presented by the slanted member to which the exterior wall surface would be fastened using nails or other conventional fastening means. As is discussed more below, the triangular trusses are used for those walls which are earth covered. For walls not earth covered, conventional "vertical wall" construction may be used.

The plurality of trusses 130 and 140 comprising side walls of 162 and 164 at the rear egress 100 of the structure would be oriented perpendicular to the rear of the remaining structure as shown and discussed below in connection with FIG. 7. It is envisioned that a series of steps 120 (FIG. 8) would be constructed from the first floor of the structure leading up to the doorway 150. In the preferred embodiment, doorway 150 would be positioned on the second, or uppermost floor. It is this doorway 150 through which access to the rear of the structure would be made.

In general, it is contemplated that the upper floor of the rear of the structure would be "dug out" such that rear wall (not shown) of rear egress 100 is exposed, i.e. not covered with earth. It will be recalled from the discussion that walls covered with earth would utilize the slanted wall truss design disclosed herein. Therefore, if the rear wall 160 is exposed, it would comprise a generally vertical design using vertical support studs 170 as illustrated, as opposed to the slanted truss construction for the side walls 162 and 164 of rear egress 100. If the base of doorway 150 is not at surrounding ground level, a series of external steps 125 could be used to ascend or descend to ground level. The remaining structure components in rear egress 100, such as the floor joists and the like, would be constructed in a fashion equivalent to that for the remaining structure. If the rear wall (not shown) of the lower floor of the rear egress 100 is underground, it would be constructed using the slanted wall technique with trusses 130 as illustrated clearly in FIG. 8 below.

FIG. 7 is a top view of the rear egress 100 of the present invention. The view in FIG. 7 is of the top, egress floor and does not include any lower floors. As indicated in this view, the roof joists 185 run from front to back of the structure, including the rear egress portion of the structure, as in a conventional construction.

As mentioned above and seen clearly in the view of FIG. 7, rear egress 100 comprises a rearward extension of the structure. The principle components of rear egress 100 are the two side walls 162 and 164 and rear wall 160 (not shown). Side walls 162 and 164 and the lower floor of rear wall 160 would likely be earth-sheltered, whereas upper floor rear wall 160 is likely to be exposed. Consequently, side walls 162 and 164 and the lower floor rear wall (not shown) would be built according to the slanted wall truss construction techniques discussed herein. Conversely, upper floor rear wall 160 would be built using conventional, i.e. vertical wall, construction.

Figure 8:
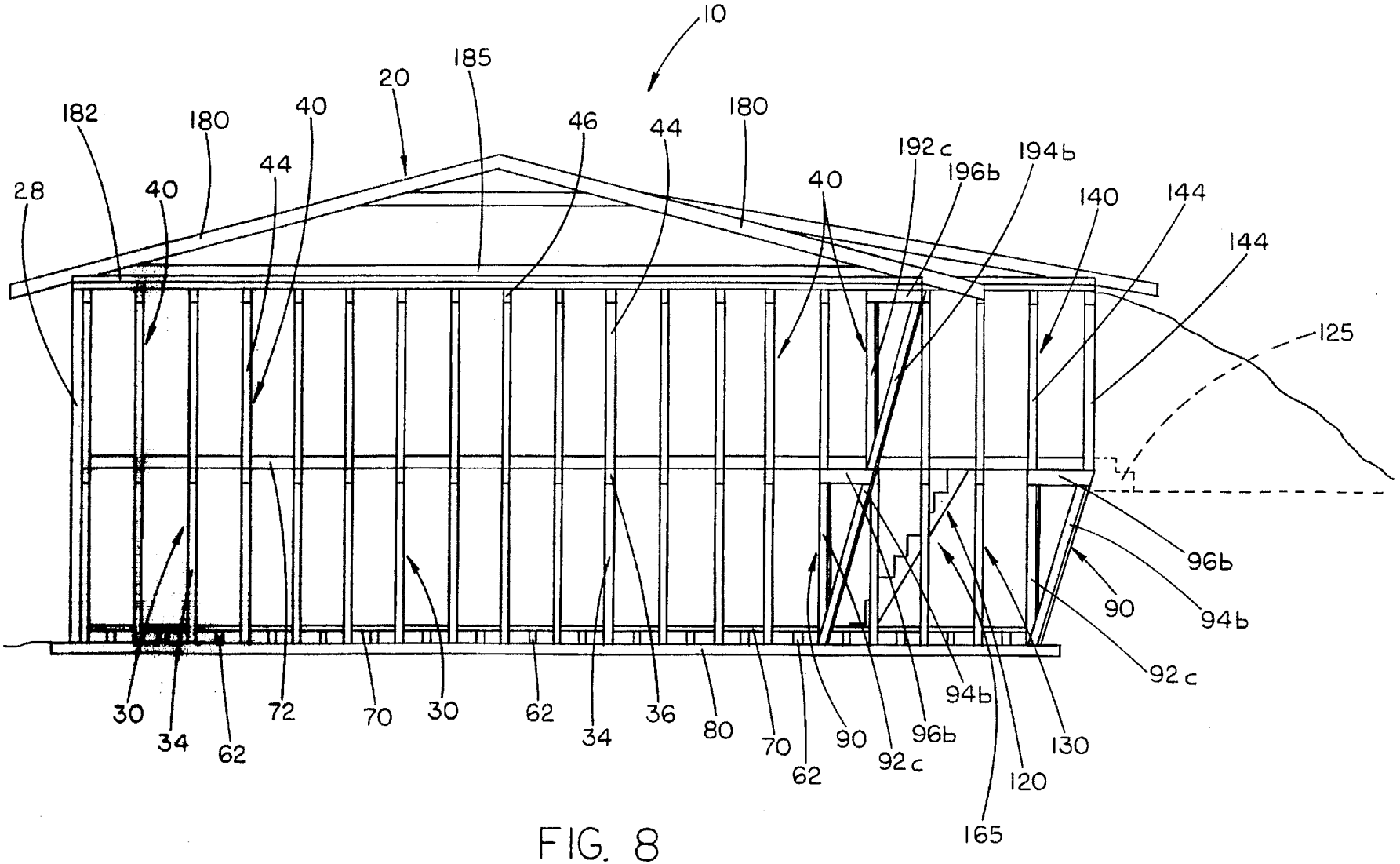

FIG. 8 is a side view of an example of an entire structure utilizing the framing structure of the present invention. As mentioned above, most earth-sheltered dwellings are built into a hill with the front of the structure exposed. Consequently, the front wall 28 of the structure is constructed conventionally with a generally vertical wall as shown. Similarly, the upper floor rear wall 160 (not shown) of rear egress 100 is generally not earth covered and therefore constructed with conventional vertical walls. Conversely, since it is likely that the lower floor rear wall (not shown) would be earth covered, it would be built using the slanted truss construction discussed above. Furthermore, it will be noted from the figure that corner pieces 190 and 90 are shown for main structure second floor rear wall and main structure and rear egress first floor rear walls indicative of the slanted nature anticipated for these walls. Finally, a stair step 125 may be provided in order to accommodate a difference between the door 150 and the surrounding earth.

The remaining exterior walls, i.e. main structure and rear egress 100 side walls as well as the rear wall of the main structure, would be constructed using the slanted wall construction taught by the present invention.

As discussed above, one point of distinction between this first embodiment and the alternative embodiment discussed below is the design of the roof 20. In this first embodiment, it is anticipated that a conventional, exposed roof would be used. Such a roof 20 is illustrated in FIG. 8. The roof joists 185 would be run from a plate 182 atop the front wall 28 to the rear wall. To these roof joists 185 would be mounted the roof rafters 180 in the conventional manner. Due to the relative light weight of a conventional roof, such as that illustrated in FIG. 8, the wall trusses 30 and 40 are sufficient for support. However, in the case of an earth covered roof, sufficient weight is present that additional structural support may be necessary. This is the motivation for the alternative embodiment below.

As mentioned above in connection with FIGS. 6 and 7, it is anticipated that entry and exit from the structure would be made from the second floor. In that case, a set of stairs 20 would probably be provided in the rear egress 100. One such set of stairs 120 is illustrated in FIG. 8. It will be clear that many other configurations of stairs 120 are possible. Additionally, it may be seen from the figure that the construction of stairs 120 as shown would define space 65 in the first floor of the egress. Such a space 165 may be used as a mechanical room or the like.

Figure 9:
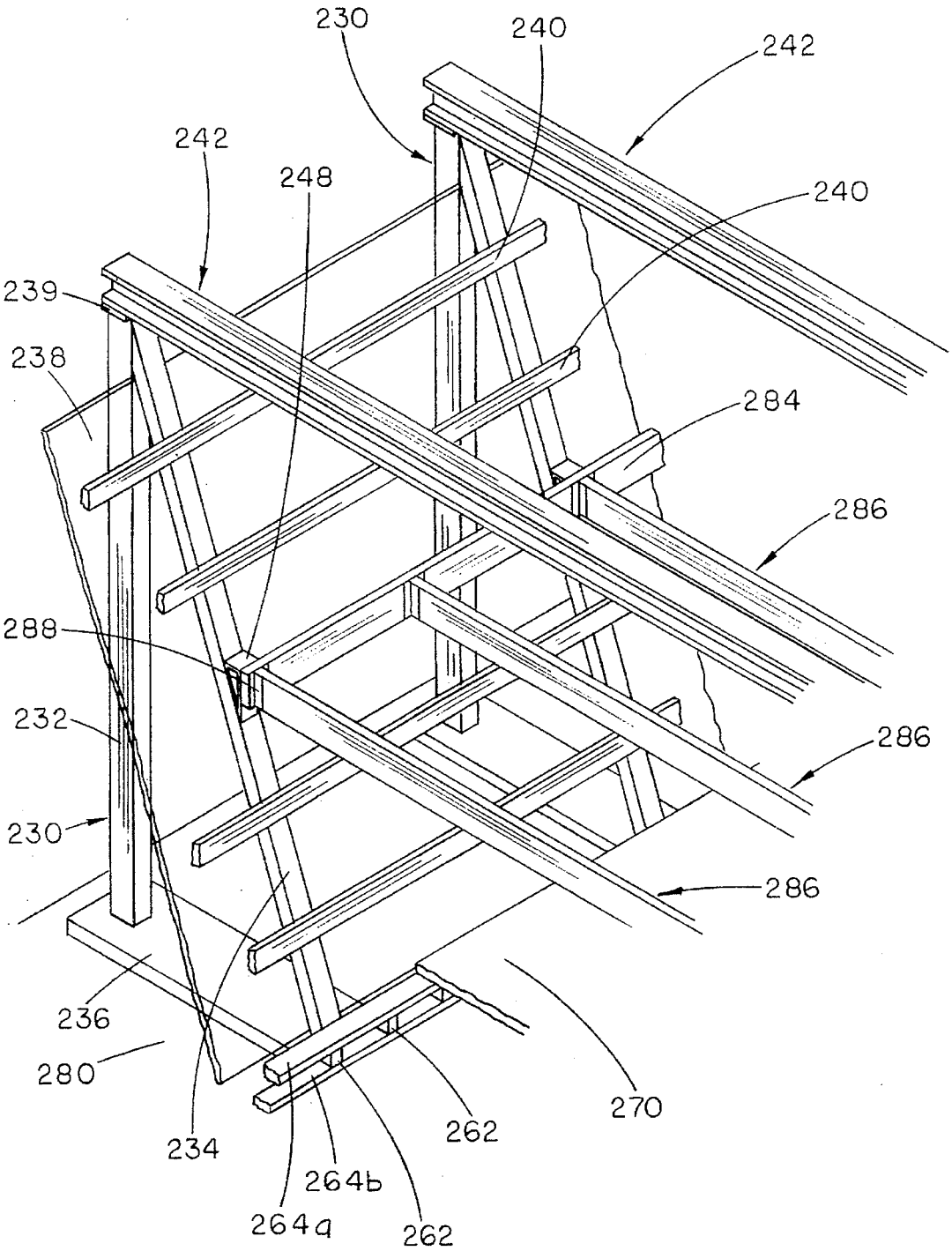
FIGS. 9–13 illustrate an alternative embodiment for the present invention.

FIGS. 9–3 illustrate the second, alternative embodiment. This second, alternative embodiment is referred to as the "exterior frame" embodiment. One major point of distinction between this secondary embodiment and the primary embodiment is the use of a single truss to provide the external support structure for all levels of the multi-level structure. Therefore, there is no stacking of trusses corresponding to the number of floors in the structure, as there is in the primary embodiment. Another major distinction is the type of roof used. As mentioned above, in some situations it may be desirable to utilize an earth covered roof. In this case, it might be necessary to provide some additional structural support therefor. The alternative embodiment discussed below provides additional support.

FIG. 9 is a perspective view showing the construction of a truss 230 according to the support structure of the second embodiment of the present invention. A plurality of trusses 230 are used to provide the support for the structure. As discussed in the primary embodiment, the trusses described here would be utilized on those exterior walls where the wall is covered with earth. Where the wall is exposed, it would likely be constructed using conventional, vertical wall techniques. As in the primary embodiment, the truss comprises an upwardly and outwardly slanted piece 234 and a vertical piece 232. However, in the case of the second embodiment, the two members are joined at their respective tops, thereby creating a downwardly opening V-shape as seen in the figure. An additional point of distinction between the first and second embodiments is that the generally vertical member 232 is positioned outwardly of the slanted member 234. It is contemplated that in one preferred design, members 232 and 234 could be I-beams which would provide great structural support. It is also envisioned that these beams could be covered with plaster or the like to prevent rusting etc. As in the above embodiment, members 232, 234 and 236 may be individual components or integrally formed.

In this second embodiment, a plurality of vertically spaced, horizontal support members 240 are fastened to the interior face of the slanted member 234. An exterior wall 238 is secured to the exterior of the horizontal support members 240 between consecutive trusses 230. As with the primary embodiment, this exterior wall 238 may be constructed of sheets of plywood or the like. Thus, the exterior wall 238 will be inclined at an angle equal to the angle of inclination of slanted member 234. This slanted exterior wall 238 serves the same purpose of exterior wall 38 and 48 in the primary embodiment, namely, to reduce a portion of the load exerted by the earth against the structure. Therefore, exterior wall 238 rests atop the fill dirt which is pushed up against the exterior wall once the framing has been completed.

As can be seen in the figure, the lower portions of members 232 and 234 are further supported in a spaced apart relation by their securement to base 236. Base 236 thus completes the generally triangular shape of truss 230. In a preferred embodiment, the base 236 of trusses 230 would be mounted on a concrete slab 280 which would form a foundation for the structure. Alternatively, in some cases it might be preferable to mount the trusses on gravel or even on dirt, depending on the environmental situation in which the structure exists. However, in most situations, the use of a concrete slab 280 would provide the most suitable foundation support for the structure. As with members 232 and 234, base 236 may also be fabricated using an I-beam.

In a fashion similar to that in the primary embodiment, the floor 270 of the lowest level is adapted to be positioned atop, and secured to, a plurality of support studs 262. In a preferred embodiment, the floor support studs 262 could assume any number of acceptable forms but in simplest form could be a series of small 2×4 sections. In a fashion identical to the primary embodiment, support studs 262 would be mounted between two horizontally running plates **264*a* and 264*b* to provide additional support and stability. The lower plate 264*b* would be positioned on the concrete foundation or gravel bed. The plate 264*b* could be secured to concrete foundation slab 280 by means of concrete nails or other similar fastening means familiar to those skilled in the art. The floor 270 in turn would be secured to upper plate 264*a* by means of conventional nails or the like. Use of discrete floor support studs 262 permits not only a strong support for floor 270 but also permits the air flow necessary to effect a thermal envelope as discussed above. In the situation where a thermal envelope is to be employed, the height of floor support studs 262 would be sufficient to raise the lower surface of floor 270 to the level of the truss base 236** or above.

As also seen in this figure, each truss 230 comprises a top plate 239 having a generally square shape mounted at the juncture of the two truss members 232 and 234. This top plate 239 may be used for mounting a roof support I-beam 242 as indicated in the figure.

As mentioned above, the main use for this alternative embodiment illustrated in FIGS. 9–13, is the situation where an earth-sheltered roof is to be utilized. In that case, the roof 244 typically would be formed of precast concrete slabs. These preformed concrete slabs, especially when earth covered, have a weight much greater than that associated with a conventional wood roof. Therefore, a support structure must be capable of supporting this additional weight. In the present embodiment, additional support is provided by trusses 230 and the steel I-beams 242 mounted to the top plate 239. In a preferred embodiment, these horizontally spaced I-beams 242 would run from front to back of the structure as in conventional structure construction. The preformed concrete slabs 244 comprising the roof would then be secured to the top of I-beams 242 as indicated in the figure.

Finally, as mentioned above, the vertical extent of trusses 230 corresponds to the total height of the structure. Thus, intermediate flooring would be positioned along the vertical extent of the trusses 230. Therefore, a means must be provided for mounting and support of these intermediate floors. One preferred means for accomplishing this in the alternative embodiment is to mount a horizontally oriented I-beam 246 on the interior of the slanted member 234. This method is discussed in detail below in connection with FIG. 13. Another preferred method of supporting intermediate floors is illustrated in FIG. 9.

In the embodiment illustrated in FIG. 9, the intermediate floors, such as 272, would be supported by a series of floor joists 286. These floor joists 286 provide a means onto which intermediate floor levels may be mounted for support. In the embodiment illustrated in FIG. 9, a two-story structure is provided. Thus, there is one intermediate floor level supported by floor joists 286. As with roof support beams 242, floor support joists 286 would likely be oriented to run front to back of the structure. Floor joists 286 would preferably be supported by a plate such as 284. Floor joists 286 may be secured to plate 284 by means of conventional support brackets 288 or the like. This joist support plate 284 would run between truss pairs being secured to the front of mounting bracket 248 which is in turn secured to the front of slanted member 234 of truss 230 using conventional bolts or the like. It is contemplated that plate 284 and floor joists 286 would be 2×10s but could clearly be other suitable supports. Details of the construction of the intermediate floors is given below in connection with FIG. 13.

Figure 10:
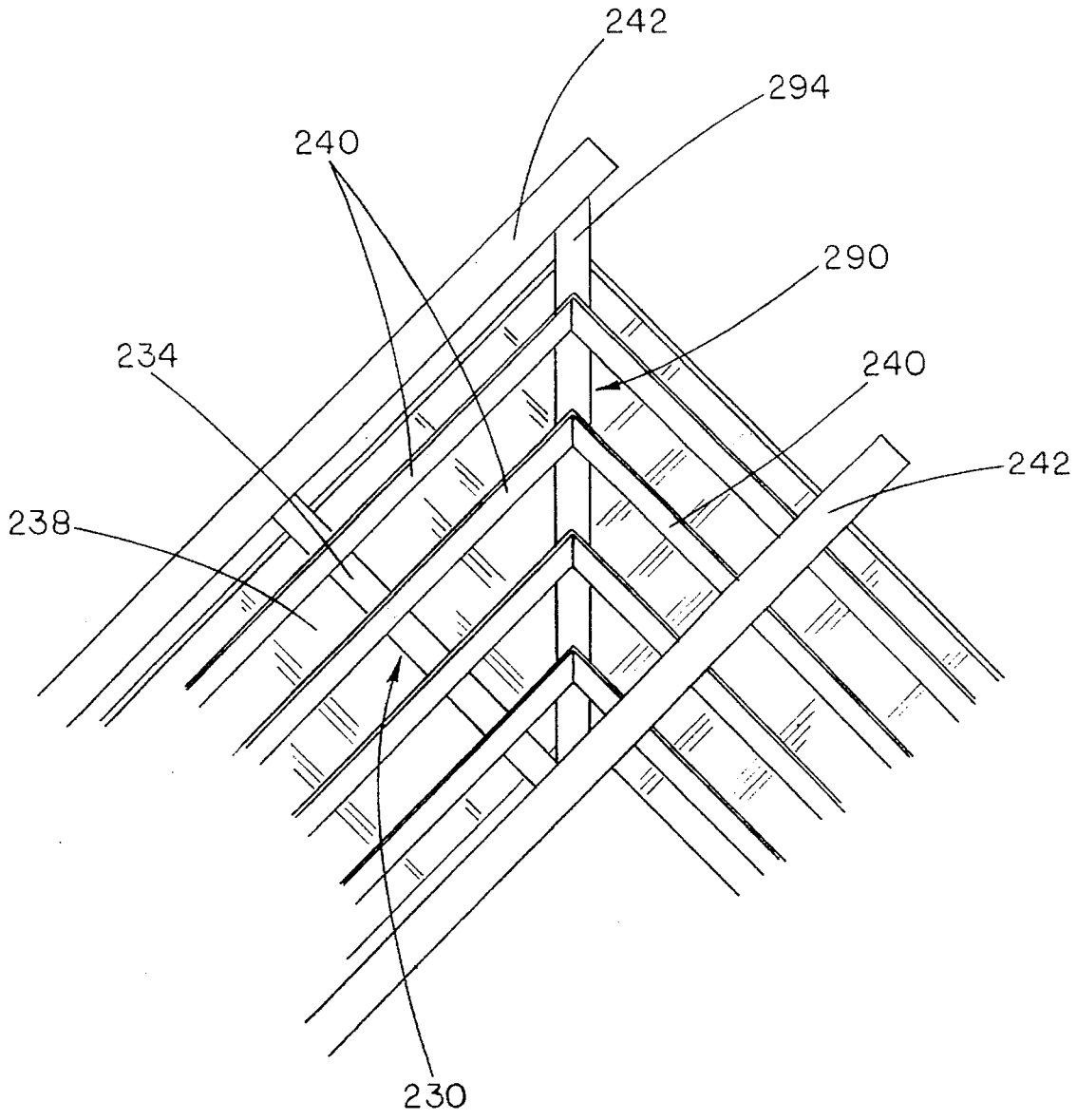

FIG. 10 is a top view of the structure embodying the alternative embodiment of the present invention. As seen in this figure, a corner is constructed in a fashion similar to that in the primary embodiment wherein the outwardly slanted member 294 of a corner piece 290 is used at the intersection of the horizontal support members 240 of adjacent walls. Additionally, as seen in this view, the horizontal roof support I-beams 242 are positioned mounted to the top plate 239 (not shown) at the top of each truss member 230. The preformed concrete slabs 244 comprising the roof of the alternative embodiment would then be mounted secured to and supported by the roof support I-beams 242.

Figure 11:
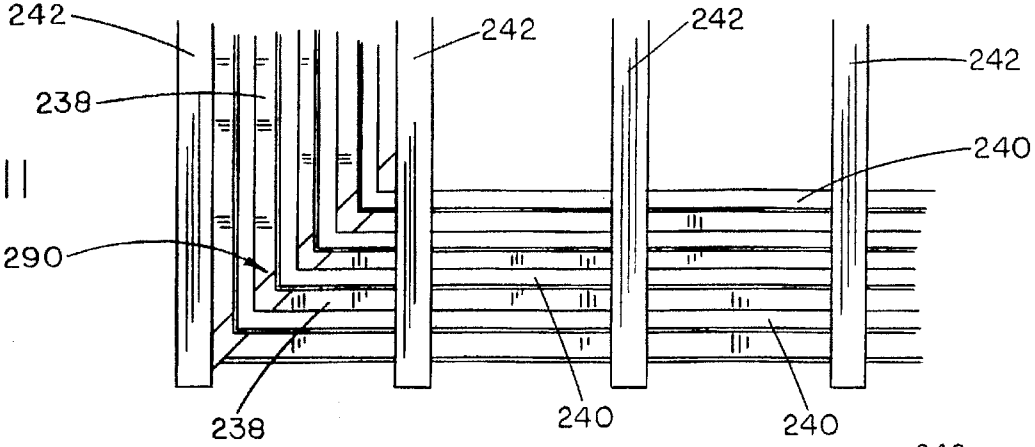

FIG. 11 is another top view showing a more extended portion of a wall built according to the alternative embodiment of the present invention. Seen clearly in this view are the roof support I-beams 242 which would run from the front to rear of the structure and are mounted to the top of each truss 230. Since the intermediate floor support I-beams 246 would likely also run front to back they would be hidden from the view of FIG. 11.

Figure 12:
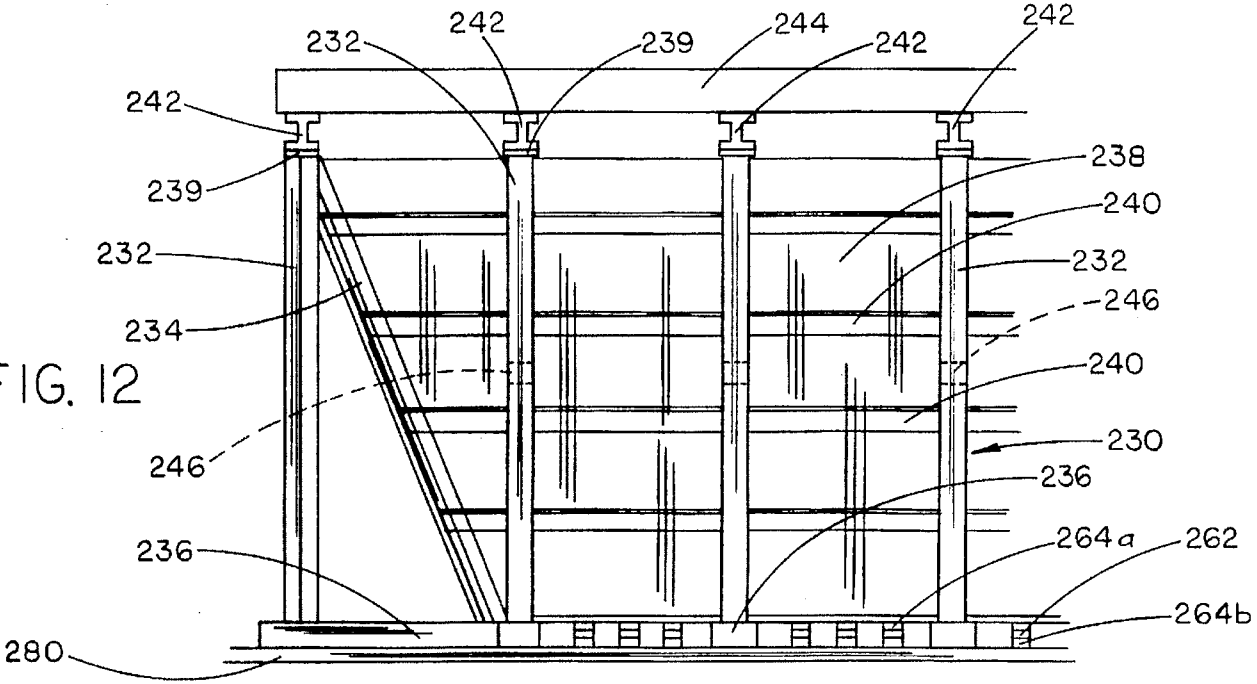

FIG. 12 is a rear view of the second embodiment of the present invention showing with particular clarity the mounting and support of the roof 244 atop the roof support I-beams 242 mounted to the top of each truss member 230. Also seen especially clearly in the view of FIG. 12 is the slant associated with member 234 of truss 230. As stated above, this slant is used to deflect some of the side loading associated with the dirt surrounding the earth-sheltered structure. As mentioned above, the dirt would be pushed up against the exterior wall 238 mounted between each consecutive truss 230 and against the horizontal mounting members 240. The roof support I-beams 242 are oriented front to back of the structure. Thus they are shown "end on" in the view of FIG. 12. Additionally, the intermediate floor support beams 246 shown in hidden lines, are also adapted to run front to back of the structure.

Figure 13:
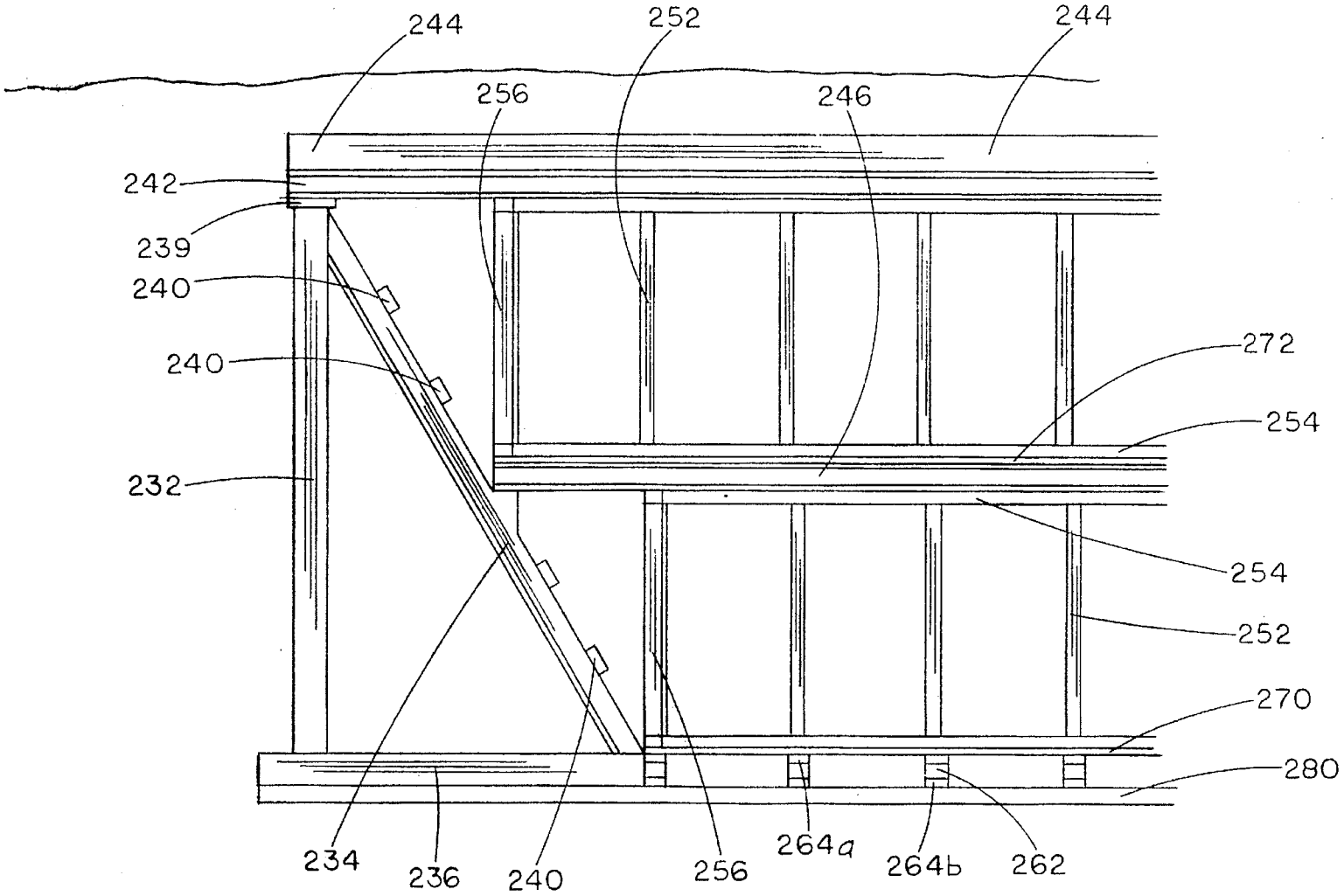

FIG. 13 is an enlarged side sectional view of the structure of another alternative embodiment of the present invention. The view taken for this figure is of a truss used on the rear walls of the structure. As mentioned above, in this alternative embodiment, the height of the truss 230 corresponds to the height of the structure. Thus, intermediate floors must be supported along slanted member 234. As seen in the embodiment of FIG. 13, the means for supporting the intermediate floor is a series of I-beams 246. The floor support I-beams illustrated in FIG. 13 provide an alternative to the floor joists 286 discussed above in connection with FIG. 9. These floor support I-beams 246 are supported on truss 230. A notch or ledge is provided on the front face of member 234 adapted to support the end of I-beam 246 as seen in the figure. It is envisioned the floor support I-beams 246 would run front to back of the structure as would the roof support beams 242. The floor 272 of the second level would be supported by these floor support I-beams 246 onto which the floor 272 could be attached. In this case, the floor I-support beams 246 would take the place of conventional floor joists such as those illustrated above in connection with FIG. 9. The floor support I-beams of FIG. 13 could be used in more structurally demanding situations such as in clear span warehouses or the like. As seen in the figure, the wall studs 252 in the first and second floors would be mounted to the floor and upper I-beam in the conventional manner using plates 254. Corner piece 256 provides a means for joining adjacent wall segments.

As seen in the figure and discussed above, horizontal cross members 240 span between consecutive truss pairs. These horizontal members 240 are used both for lateral support as well as to support exterior wall 238 (not shown). As discussed above, the exterior wall 238 is mounted at an angle which corresponds to the angle of inclination of member 234. This angular orientation of the wall in combination with the increase structural integrity resulting from the triangular truss configuration achieves the increased structural support allowing a multi-level sheltered structure to be built.

Finally, FIG. 13 illustrates the positioning of roof support beams 242 mounted to the top of truss 230 using plate 239. As mentioned above, in the preferred embodiment, the roof support I-beam 242 would be oriented from the front to the rear of the structure. The concrete roof 244 would be positioned on top of these roof support I-beams 242 as shown. The roof 244 would likely be comprised of preformed slab portions but many alternative designs are possible. The weight of roof 244 would probably provide force sufficient to keep it in place precluding the need for securement means. However, if additional securement is desired bolts or the like may be used.

It is obvious that numerous other modifications and variations of the present invention are possible in view of the above teachings. For example, as mentioned above the present invention is directed primarily at the exterior structure framing. Consequently no interior details except the basic wall structure were discussed. Rather, the interior design may be chosen as desired to accommodate the specific tastes of the owner. Construction of interior walls may be accomplished in the conventional manner. Of course the truss members could be constructed of individual components or formed integrally from a single piece. Additionally, several methods may be used to support the floor as were discussed.

Therefore it is to be understood that the above description is in no way intended to limit the scope of protection of the claims and is representative only of the several possible embodiments of the present invention.

There has thus been shown and described an invention which accomplishes at least all of the stated objects.

I claim:

1. In a multi-level, earth sheltered structure having a foundation for supporting the structure and of a shape corresponding to the exterior shape of the structure; a first floor corresponding to the lowest level; means for supporting the first floor proximate to the structure foundation thereby defining a first level of the multi-level structure; a second floor, means for supporting the second floor thereby defining a second level of the multi-level structure; a roof, means for supporting the roof adjacent the top of the uppermost level such that an enclosed, multi-level earth supported structure is formed thereby, an exterior framing structure adapted to support an exterior wall and for supporting the structure comprising:

a plurality of truss pairs, each of said pairs being formed by a lower first truss and an upper second truss, each of said trusses having a top and a bottom and including, a first generally vertical elongated inner member having top and bottom portions, a second outer elongated member having top and bottom portions, said outer member bottom portion being joined with said inner member at the bottom portion thereof, a connecting member connecting said inner and outer member top portions in a spaced apart relation such that said second member slopes upwardly and outwardly from the bottom portion thereof thereby defining an angle between said inner and outer members, whereby each truss is generally triangularly shaped;

said bottom of said upper second truss being attached to said top of said lower first truss such that said second outer members of both trusses in said pair are generally aligned to present a substantially continuous outwardly sloping surface; and means for securing said plurality of truss pairs to the foundation in said horizontally spaced apart relation such that when the exterior wall is fastened thereto, an exterior frame for the structure is formed thereby.

2. The exterior framing structure for supporting a structure of claim 1 wherein the exterior framing structure comprises a main structure having front, rear, and two side walls and wherein said exterior framing structure further comprises a rear egress having two side walls and a rear wall, said side walls adapted to connect to and project rearwardly of said main structure rear wall, said rear egress rear wall comprising a passageway therethrough such that said structure is accessible therethrough.

3. The exterior framing structure for supporting a structure of claim 2 wherein said main structure side and rear walls and said rear egress side walls are constructed using said truss pairs.

4. The exterior framing structure for supporting a structure of claim 1 wherein said first floor further comprises a floor support means having a top plate and a bottom plate and a series of floor support studs mounted between said top and bottom plates, said top plate positioned adjacent the bottom surface of said first floor and said bottom plate positioned on the foundation, said floor support means having a height sufficient to permit the flow of air between said floor and said foundation.

5. The exterior framing structure for supporting a structure of claim wherein said structure further comprises a plurality of floor joists for supporting said second floor and wherein said joists are adapted to be supported on said connecting member of said lower first truss.

6. The exterior framing structure for supporting a structure of claim 3 wherein said front wall is generally vertical.

7. The exterior framing structure for supporting a structure of claim 1 wherein said foundation is concrete and said trusses are constructed of wood.

8. The exterior framing structure for supporting a structure of claim 1 wherein said trusses are constructed of aluminum.

9. The exterior framing structure for supporting a structure of claim 1 wherein said trusses are constructed of steel.

10. The exterior framing structure for supporting a structure of claim 1 wherein said angle between said inner and outer truss members is between zero and eighty-nine degrees.

11. A subsurface frame for enclosing and supporting an earth sheltered, multi-level structure comprising:

a plurality of truss pairs, each of said pairs being formed by a lower first truss and an upper second truss, each of said trusses having a top and a bottom and including, a first generally vertical elongated inner member having top and bottom portions, a second outer elongated member having top and bottom portions, said outer member bottom portion being joined with said inner member at the bottom portion thereof, a connecting member connecting said inner and outer member top portions in a spaced apart relation such that said second member slopes upwardly and outwardly from the bottom portion thereof whereby each truss is generally triangularly shaped;

said bottom of said upper second truss being attached to said top of said lower first truss such that said second outer members of both trusses in said pair are aligned to present a substantially continuous outwardly sloping surface;

a foundation for supporting said truss pairs in horizontally spaced apart relation defining the exterior shape of said structure;

means for securing said plurality of truss pairs to said foundation in said horizontally spaced apart relation;

a first floor;

means for securing said first floor proximate to said bottoms of said plurality of said first trusses thereby partially defining a first level of said multilevel structure;

a second floor;

means for securing said second floor adjacent said tops of said plurality of said first trusses thereby partially defining a second level of said multilevel structure;

an exterior wall;

means for securing said exterior wall to said first and second truss members respectively;

a roof; and means for supporting said roof adjacent said top of said second trusses such that an enclosed, multi-level earth supported structure is formed thereby.

12. The subsurface frame of claim 11 further comprising a rear egress, said rear egress having two side walls and a rear wall positioned therebetween said rear egress being positioned adjacent said rear wall.

13. The subsurface frame for enclosing and supporting an earth sheltered, multi-level structure of claim 11 wherein said truss pairs are utilized to construct side and rear walls of said structure and wherein a front wall of said structure is constructed with generally vertical framing.

14. A subsurface frame for enclosing and supporting an earth sheltered, multilevel structure comprising:

a plurality of horizontally spaced, generally vertical trusses each of said trusses having, a base, a top, and a generally vertical member therebetween, said base extending inwardly of said top, the height of said vertical member corresponding to the number of levels in said multi-level structure;

said truss further having a slanted member extending from said top to said base of each of said vertical members thereby defining a triangle with each of said trusses;

a plurality of vertically spaced apart, generally horizontal support members secured to said slanted members;

an exterior wall secured to said horizontal support members between each of said slanted members forming an upwardly and outwardly sloping wall;

a first floor having top and bottom surfaces and being supported around the periphery thereof by said vertical member bases;

a plurality of floor support studs adjacent the bottom surface of said first floor and distributed therearound for support thereof;

a first floor interior wall;

a plurality of first floor interior support wall studs secured at the lower end thereof to said first floor and adapted to support said first floor interior wall;

a second floor having top and bottom surfaces, said bottom surface being connected to and supported by said first floor interior support wall studs at the tops thereof;

a second floor interior wall;

a plurality of second floor interior support wall studs secured at the lower end thereof to said first floor and adapted to support said second floor interior wall;

a roof;

a plurality of horizontal, spaced apart roof support members supported by said vertical member tops, said roof support members adapted to support said roof in a generally horizontal orientation such that earth may be supported thereon; and said roof support members cooperating with said interior and exterior walls to support said roof, thereby forming an multi-level, earth sheltered enclosure.

15. The subsurface frame for enclosing and supporting an earth sheltered, multilevel structure of claim 14 wherein said first and second floor interior wall support members are "2×4" studs.

16. The subsurface frame for enclosing and supporting an earth sheltered, multilevel structure of claim 15 wherein said first floor interior wall "2×4" studs are spaced horizontally by between approximately 18 and 24 inches.

17. A method of enclosing and supporting an earth sheltered, multi-level structure comprising:

excavating an area corresponding generally to the dimensions of the earth sheltered structure;

forming a foundation to support the structure;

providing a plurality of truss pairs, each of said pairs being formed by a lower first truss and an upper second truss, each of said trusses having a top and a bottom and including, a first generally vertical elongated inner member having top and bottom portions, a second outer elongated member having top and bottom portions, said outer member bottom portion being joined with said inner member at the bottom portion thereof, a connecting member connecting said inner and outer member top portions in a spaced apart relation such that said second member slopes upwardly and outwardly from the bottom portion thereof thereby defining an angle between said inner and outer members, whereby each truss is generally triangularly shaped;

said bottom of said upper second truss being attached to said top of said lower first truss such that said second outer members of both trusses in said pair are aligned to present a substantially continuous outwardly sloping surface; and means for securing said plurality of truss pairs to the foundation in said horizontally spaced apart relation such that when the exterior wall is fastened thereto, an exterior frame for the structure is formed thereby;

securing said lower trusses to said foundation;

securing said upper trusses to said lower trusses;

providing an exterior wall;

securing said exterior wall to said outer truss members thereby forming an outwardly sloping exterior wall;

providing a floor corresponding to a first floor level;

providing a first floor support means;

securing said first floor to said foundation using said first floor support means such that said first floor is vertically spaced from said foundation;

providing a roof;

securing said roof to said upper truss pairs; and replacing said excavated dirt so as to encase said structure thereby forming an earth sheltered structure.

* * * * *